US009889452B2

(12) United States Patent
Danyliw et al.

(10) Patent No.: US 9,889,452 B2
(45) Date of Patent: Feb. 13, 2018

(54) METHODS FOR FACILITATING MINERAL EXTRACTION

(71) Applicant: CHEMTREAT, INC., Glen Allen, VA (US)

(72) Inventors: Brian Danyliw, Ontario (CA); John Richardson, Hanover, VA (US)

(73) Assignee: CHEMTREAT, INC., Glen Allen, VA (US)

( * ) Notice: Subject to any disclaimer, the term of this patent is extended or adjusted under 35 U.S.C. 154(b) by 587 days.

(21) Appl. No.: 14/579,550

(22) Filed: Dec. 22, 2014

(65) Prior Publication Data

US 2015/0174588 A1 Jun. 25, 2015

Related U.S. Application Data

(60) Provisional application No. 61/919,702, filed on Dec. 20, 2013.

(51) Int. Cl.
*B03D 1/02* (2006.01)
*B03D 1/12* (2006.01)
(Continued)

(52) U.S. Cl.
CPC ..... *B03D 1/02* (2013.01); *B03D 1/002* (2013.01); *B03D 1/004* (2013.01); *B03D 1/011* (2013.01);
(Continued)

(58) Field of Classification Search
CPC . B03D 1/02; B03D 1/082; B03D 1/12; B03D 1/002; B03D 1/012; B03D 1/016;
(Continued)

(56) References Cited

U.S. PATENT DOCUMENTS 2,614,692 A * 10/1952 Lawver ..... B03D 1/02 209/166
3,078,996 A * 2/1963 Snow ..... B03D 1/01 209/166
(Continued)

FOREIGN PATENT DOCUMENTS

AU 26453 71 A 9/1972
CA 866225 A 3/1971
(Continued)

OTHER PUBLICATIONS

Dec. 4, 2015 Written Opinion issued in International Application No. PCT/US2014/071949.
(Continued)

*Primary Examiner* — Frank Lawrence, Jr.
*Assistant Examiner* — Minh-Chau Pham
(74) *Attorney, Agent, or Firm* — Oliff PLC

(57) ABSTRACT

There is provided methods for separating a target material from a raw material by mixing the raw material with water to form a slurry, adding a collector compound to the slurry to modify a relative hydrophobicity of a surface of the target material, adding a facilitator compound to enhance the modification of the relative hydrophobicity of the surface, and forming a froth including a concentrate of the target material. Disclosed methods may also include adding a facilitator compound to a raw material slurry that has been treated with a collector compound and a reagent for neutralizing the collector compound.

32 Claims, 10 Drawing Sheets

(51) Int. Cl.

| | |
|---|---|
| ***B03D 1/002*** | (2006.01) |
| ***B03D 1/012*** | (2006.01) |
| ***B03D 1/016*** | (2006.01) |
| ***B03D 1/004*** | (2006.01) |
| ***B03D 1/01*** | (2006.01) |
| ***B03D 1/018*** | (2006.01) |
| ***B03D 1/06*** | (2006.01) |

(52) U.S. Cl.
CPC ..... *B03D 1/012* (2013.01); *B03D 1/018* (2013.01); *B03D 1/06* (2013.01); *B03D 2201/007* (2013.01); *B03D 2201/04* (2013.01); *B03D 2201/06* (2013.01); *B03D 2203/02* (2013.01)

(58) Field of Classification Search
CPC ..... B03D 2201/02; B03D 2201/06; B03D 2203/04
USPC ..... 209/163, 164, 166, 167, 169
See application file for complete search history.

(56) References Cited

U.S. PATENT DOCUMENTS 3,099,620 A * 7/1963 Adam ..... B03D 1/01 209/166
3,570,772 A 3/1971 Booth et al.
3,596,838 A 8/1971 Weston
4,159,943 A * 7/1979 Petrovich ..... B03D 1/008 209/166
8,408,395 B2 * 4/2013 Domke ..... B03C 1/01 209/47
8,875,898 B2 * 11/2014 Hines ..... B03D 1/008 209/166
2003/0146134 A1 * 8/2003 Yoon ..... B03D 1/006 209/164
2003/0217953 A1 * 11/2003 Xu ..... B03D 1/02 209/163
2011/0017676 A1 * 1/2011 Franks ..... B01D 17/0202 210/705

FOREIGN PATENT DOCUMENTS

CN 102 423 728 A 4/2012
CN 102 464 600 A 5/2012
CN 102 896 050 A 1/2013

OTHER PUBLICATIONS

Apr. 4, 2016 International Preliminary Report on Patentability issued in International Application No. PCT/US2014/071949.
Tang et al., "Exploiting the influence of Oxidation on ultra-fine copper and nickelsulfide containing Pt—Pd in Yunnan Mine", 4th International Conference on Manufacturing Science and Engineering, Mar. 30, 2013, pp. 760-763.
Bulatovic, "4.3 Inorganic Modifiers", "Handbook of Flotation Reagents", Dec. 31, 2007, pp. 54-67.
Mar. 26, 2015 International Search Report issued in PCT/US2014/071949.
Mar. 26, 2015 Written Opinion issued in PCT/US2014/071949.

* cited by examiner

METHODS FOR FACILITATING MINERAL EXTRACTION

This application claims the benefit of U.S. Provisional Application 61/919,702, filed Dec. 20, 2013. The disclosure of the prior application is hereby incorporated by reference herein in its entirety.

TECHNICAL FIELD

This application is directed to methods for extracting target minerals from raw materials. Target minerals can include, for example, copper, lead, zinc, molybdenum, nickel, gold, silver, platinum, and palladium. Raw materials can include, for example, sulfide ores.

BACKGROUND

Within the mining industry, industrial plants that utilize froth flotation for concentrating desirable minerals from original ore are generally referred to as concentrators or mills. In these concentrators or mills, many processes for recovering metals from sulfide base metal ores including, for example, ores of copper, nickel, zinc, lead and combinations thereof, platinum group metal ores and gold ores, typically utilize a froth flotation process to upgrade or increase the concentration of desirable minerals before further processing that will convert these minerals into usable metals. However, conventional frothing processes suffer from a marked lack of efficiency in recovering target metals from raw material resulting in costly and ineffective refining methods. These and other issues are addressed by the present disclosure. It is an object of this disclosure to recover as much of the desirable mineral(s) as practical while maintaining a relatively high mineral content in a final concentrate. One advantage of the present disclosure over existing methods for recovering target materials is that these new methods provide a novel process with significantly increasing yields. Accordingly, the present disclosure allows for more efficient and cost effective target metal recovery processes.

SUMMARY

In a first embodiment, there is provided a method for separating at least one target material from a raw material. The method may include mixing the raw material, which includes the target material, with water to form a slurry, adding at least one collector compound to the slurry that associates with a surface of the target material and modifies the hydrophobicity of the surface, adding a facilitator compound to the slurry, the facilitator compound being effective to enhance the modification of the hydrophobicity of the target material surface by the collector compound, and forming a froth including a concentrate of the target material.

In another embodiment, there is provided a method for separating at least one target material from a slurry comprising a raw material. The method may include adding a first facilitator compound to the raw material slurry, the first facilitator compound being effective to enhance a modification of a hydrophobicity of a surface of a first target material that has been treated with a first collector compound, forming a first froth including a first concentrate of the first target material, extracting the first concentrate of the first target material from the first froth, adding a deactivation compound to the slurry that deactivates the first collector compound, adding a second facilitator compound being effective to enhance the modification of the hydrophobicity of the surface of the second target material, forming a second froth including a second concentrate of the second target material, and extracting the second concentrate of the second target material from the froth.

In another embodiment, there is provided a method for separating at least one target mineral from a raw material. The method may include mixing a metal sulfide ore, which includes the target mineral, with water to form a slurry, adding at least one xanthate compound to the slurry, adding an onium facilitator compound to the slurry, forming a froth including a concentrate of the target mineral, and extracting the concentrate of the target mineral from the froth.

DETAILED DESCRIPTION

The inventors have discovered that the effectiveness of target mineral separation from raw materials in frothing processes can be significantly enhanced by the addition of certain facilitator compounds that facilitate the action of collector compounds in separating the target mineral from the raw material. For example, the inventors have discovered that the use of quarternary onium-based compounds are particularly useful in increasing the recovery of metals from metal ores in frothing processes by enhancing the effect of collector compounds both before and after the application of reagents, such as cyanide, that may destroy or neutralize the collector compounds in downstream purification processes.

Frothing Processes Generally

Figure 1:
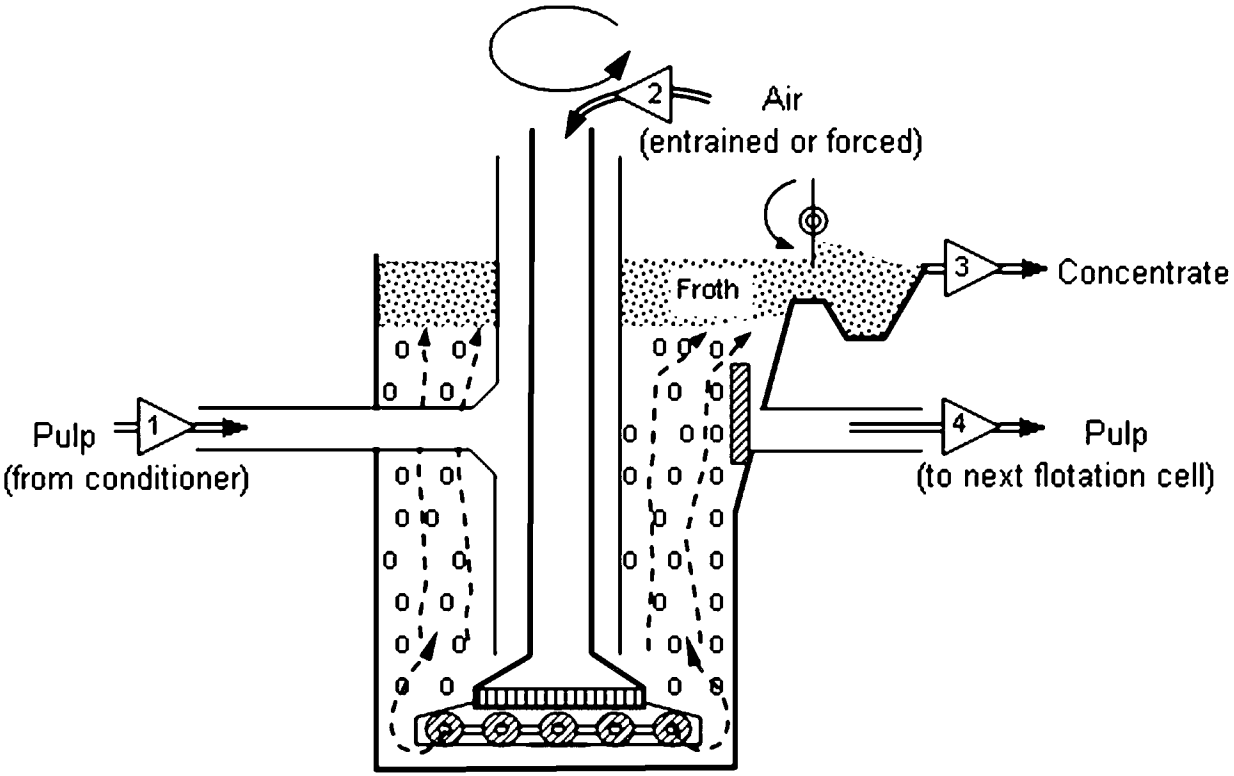
FIG. 1 is a schematic illustration of a basic froth flotation cell used in embodiments.

A basic froth flotation cell is illustrated in FIG. 1. The numbered triangles show steps in the direction of stream flow with a treated mixture of ore and water (pulp). In step 1, pulp enters the cell from a conditioner and flows to the bottom of the cell. Gases such as air, nitrogen, or the like, can be passed down a vertical impeller in the second step where shearing forces break the air stream into small bubbles. In steps 3 and 4, the mineral concentrate froth is collected from the top of the cell, while the pulp flows to another cell.

Figure 2:
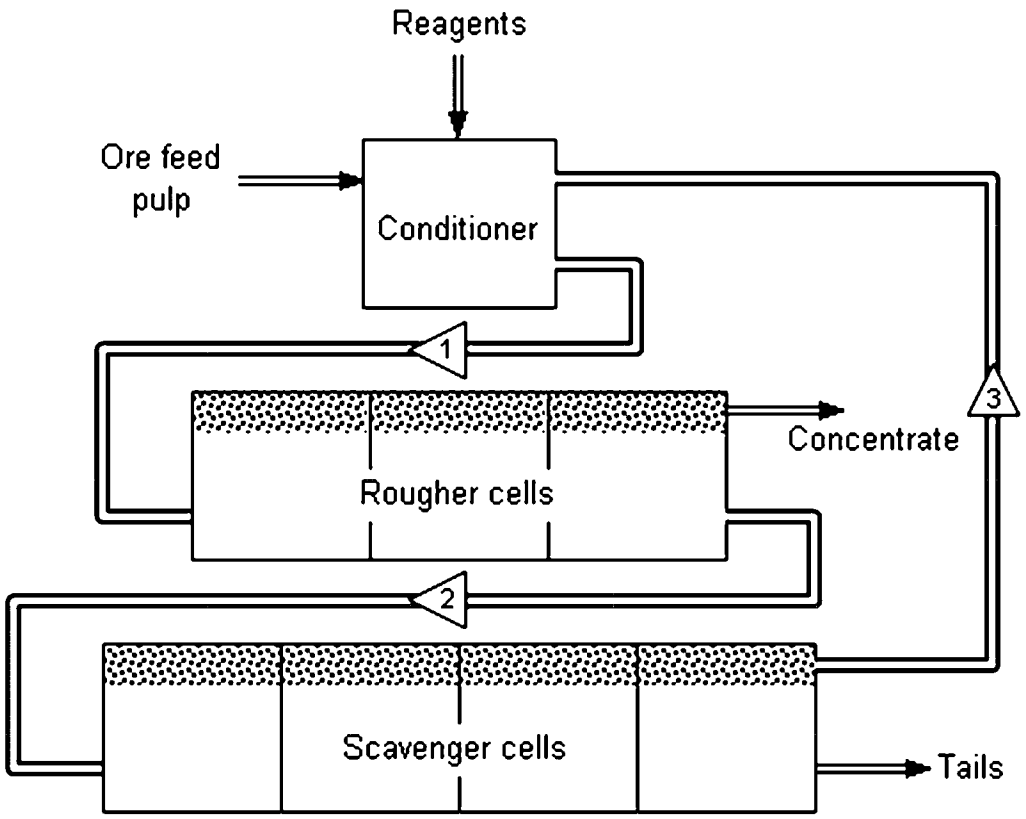
FIG. 2 is a schematic illustration of a froth flotation circuit used in embodiments.

FIG. 2 illustrates a flotation circuit for mineral concentration with numbered triangles again showing the direction of stream flow. Various flotation reagents are typically added to the ore and water pulp in a conditioning tank. The flow rate, tank size and/or agitation are designed to provide conditions sufficient to activate the minerals before being passed into the first rougher cell. In step 1, the conditioner pulp is fed into a bank of rougher cells in which most of the desired minerals are removed as a concentrate. In step 2, the rougher pulp then passes the remaining slurry into a bank of scavenger cells where additional reagents may be added and/or the ore may be subjected to additional mechanical processing (not shown). In step 3, the scavenger cell froth may then be returned to the rougher cells for additional treatment or, in some cases, may be sent to special cleaner cells. The scavenger pulp is usually sufficiently barren to be discarded as tails. More complex flotation circuits may have several sets of cleaner and re-cleaner cells, and may include intermediate re-grinding of pulp or concentrate and/or additional chemistries and treatments designed for improving separation and/or purity of the concentrate.

Froth flotation processes according to embodiments are directed to preferential separation of one or more target minerals from gangue by taking advantage of differences in their relative hydrophobicity. In order to improve the separation, the initial differences in hydrophobicity between the valuable mineral(s) and the waste gangue may be increased by using one or more surfactants and/or wetting agents. The selective separation of the minerals achieved via froth flotation improves the economics associated with processing complex (i.e., mixed) ores. In embodiments, flotation processes may be used for separating a large range of sulfides, carbonates and oxides prior to further refinement. Phosphates and coal may also be upgraded (purified) by applying appropriate flotation technology.

Hydrophobicity can work by chemisorption and physisorption. In chemisorption, ions or molecules from solution undergo a chemical reaction with the surface, becoming irreversibly bonded to the surface and thereby permanently changing the nature of the surface. Chemisorption of collectors is highly selective as the chemical bonds are specific to particular atoms. In physisorption, ions or molecules from solution become reversibly associated with the surface, attaching due to electrostatic attraction or van der Waals bonding. The physisorbed substances can, in turn, be desorbed from the surface if conditions such as pH or composition of the solution changes. Physisorption also tends to be much less selective than chemisorption, as collectors will adsorb on any surface that has the correct electrical charge or degree of natural hydrophobicity.

Methods for Facilitating Mineral Extraction

Aspects of this disclosure may include separating a target material from a raw material. The method may include mixing the raw material with water to form a slurry and adding at least one collector compound to the slurry to modify a relative hydrophobicity of a surface of the target material. The method may further include adding a facilitator compound to enhance the modification of the relative hydrophobicity of the surface and forming a froth including a concentrate comprising the target material.

Further aspects of this disclosure may include adding a deactivating compound such as, for example, cyanide that deactivates a first collector compound. The method may include adding a second collector compound to the slurry to modify a relative hydrophobicity of a surface of a second target material. The method may further include adding a second facilitator compound to enhance the modification of the relative hydrophobicity of the surface of the second target material and forming a second froth including a concentrate comprising the second target material. The second collector compound may be different or the same as the first collector compound. The second facilitator compound may be different or the same as the second collector compound.

According to embodiments, the raw material may be any suitable raw material such as, for example, sulfide mineral ores. Sulfide mineral ores are those ores comprising at least one metal capable of forming a complex comprising a covalently bonded crystal structure between the metal and sulfur ions and includes, for example, pyrite, arsenopyrite, pyrrhotite, stilbnite, chalcopyrite, bornite, chalcocite, covellite, galena, sphalerite, molybdenite, and mixtures thereof.

The metals comprising the target mineral may also include, but are not limited to, other base metals such as, for example, copper, lead, zinc, molybdenum, nickel, and mixtures thereof, and precious metals, such as, for example, gold, silver, platinum, palladium, and mixtures thereof.

Embodiments may include a preliminary process generally known as comminution or liberation, in which raw material ore may be processed through one or more crushing and grinding stages in order to reduce the ore to a particle size range in which the various minerals will tend to exist as physically separate grains. Complete liberation may not be required for rougher flotation. Instead, only a degree of liberation may be sufficient to release enough gangue from the valuable mineral to get an acceptable recovery.

As a result of liberation, the particle sizes may be in the range of less than 100 μm, or preferably, less than 10 μm to achieve sufficient separation of the minerals within the original ore. There is a tendency for the liberation size of the minerals to decrease over time as the ore bodies with coarse mineral grains that can be separated at larger sizes are depleted and replaced by ore bodies that were formerly considered too difficult.

Embodiments may also include a roughing step. In a roughing step, a rougher raw material concentrate is produced. The primary objective of roughing is to recover as much of the valuable minerals as possible, with less emphasis on the quality of the concentrate produced. The objective in the roughing stage is to remove a significant portion of the targeted mineral at one or more relatively coarse particle sizes. By removing minerals at larger particle sizes, less additional energy may be required for additional grinding/crushing in order to produce a finer particle distribution. There may also be a pre-flotation step that precedes roughing. This technique may be used in instances where the crushed ore also includes undesirable materials, such as organic carbon, that readily float. These materials may be removed first to avoid having them come of in the froth during the roughing stage and contaminating the rougher concentrate.

The rougher concentrate may be subjected to additional grinding (usually called regrinding) in order to obtain a more complete liberation of the target minerals. Because the rougher concentrate constitutes a much smaller mass than that of the original ore feed, less energy may be expended during the regrinding operation than if the entire ore feed was subjected to the regrinding. Regrinding may be conducted in specialized regrind mills that are configured for further reducing the energy consumed in reducing the rougher concentrate to produce finer particles.

Liberate particles may then be mixed with the raw material with water to form a slurry and subjected to a flotation process. Flotation is normally undertaken in several stages to increase the overall recovery of the target mineral(s) and/or increase the content of those minerals in the concentrate.

Collecting

The methods may include adding at least one collector compound to the pulp to modify a relative hydrophobicity of a surface of the target material. This process renders the desired mineral hydrophobic by the addition of one or more surfactants or collector chemicals. In some instances, the target mineral surfaces are naturally hydrophobic and may require little or no additional chemical modification through the addition of a surfactant or collector composition to achieve suitable separation. Selection of the particular surfactant(s) and/or collector chemical(s) can be a function of the surface parameters of the target mineral and/or the surface parameters of the other ore components in order to achieve the desired separation.

The collector compounds may be added as a collector in the selective flotation of target materials. The collectors typically act on the target particles through either chemisorption onto a hydrophobic mineral surface, or through adsorption onto the particle surface as in, for example, coal flotation through physisorption. Collectors act by increasing the natural hydrophobicity of the target surface relative to the raw material, thereby improving the separability of the hydrophobic and hydrophilic particles within a pulp or slurry. This slurry or pulp of hydrophobic particles and hydrophilic particles is then introduced to tanks known as flotation cells that are aerated, typically through sparging, to produce bubbles near the bottom of the cell. The hydrophobic particles attach to the air bubbles, which rise to the surface, and form a froth on the top of the flotation cell on the surface of the remaining slurry. The froth is then removed from the cell, thereby producing a concentrate of the target mineral.

In embodiments, the collector compound may be a xanthate compound, such as, for example, sodium ethyl xanthate ("SEX"). SEX may be added as a collector in the selective flotation of galena (lead sulfide) to separate it from sphalerite (zinc sulfide). Other xanthate compounds such as, for example, potassium amyl xanthate ("PAX"), potassium ethyl xanthate ("PEX" or "KEX"), potassium isobutyl xanthate ("PIBX"), sodium isobutyl xanthate ("SIBX"), sodium isopropyl xanthate ("SIPX") and mixtures thereof, may be used for promoting the flotation of the target or desirable mineral species thereby enhancing the concentration of desirable species in the resulting flotation concentrate. In addition to the xanthates, other suitable collectors may include, for example, dithiophosphates, thiocarbamates, xanthogen formates, thionocarbamates, thiocarbanilide, palmatic acid, and mixtures thereof.

Amines may also be used as collectors in a process known as "reverse" flotation where undesirable materials, in particular silicate and calcite compounds, are floated to separate them from desirable minerals in the recovery of iron ore, industrial minerals and potash. In this embodiment, the collector compound, the amine, may increase the relative hydrophobicity of the raw material relative to the surface of the mineral (in this case the silicate and calcite compounds would be the "target material" since it is collected in the froth).

Facilitating

The methods may include adding a facilitator compound or reagent to enhance the modification of the relative hydrophobicity of the surface and improve overall upgrading of the target material, e.g., the desirable mineral species. Facilitators may be utilized in various stages of a froth flotation process in order to selectively activate the desired mineral surfaces and/or deactivate the undesirable material surfaces in order to improve the degree of separation that can be achieved between the desirable and undesirable components of the base ore. Facilitating reagents may include promoters or depressants which are added to either augment (promoters or activators) the action of a collector or inhibit (depressants) collector action on one or more specific mineral type.

Activators are specific compounds that make it possible for collectors to adsorb onto surfaces to which they could not normally attach. One example of an activator is copper sulfate as an activator for sphalerite (ZnS) flotation with xanthate collectors. When untreated, xanthate cannot attach to the sphalerite surface because it forms a zinc-xanthate compound that quickly dissolves:

$$ZnS(s)+Xanthate \rightarrow S(s)+ZnXanthate(aq)$$

The surface of the sphalerite, however, can be activated by reacting it with a metal ion that does not form a soluble xanthate, such as soluble copper from dissolved copper sulfate:

$$ZnS(s)+CuSO_4(aq) \rightarrow CuS(s)+ZnSO_4(aq)$$

This forms a thin film of copper sulfide on the sphalerite surface, which allows for stable attachment of the xanthate, rendering the sphalerite particle hydrophobic and floatable.

Depressants have the opposite effect of activators and act to prevent collectors from adsorbing onto particular target material surfaces to which they might normally attach. They are generally used to increase selectivity by preventing one mineral from floating, while allowing another mineral to float unimpeded. Many inorganic compounds, such as, for example, cyanide (CN—) is applicable as a depressant in sulfide mineral flotation because of its apparent ability to complex with, and in some cases dissolve, a number of metal ions, preventing them from attaching to the xanthate molecules. In particular, cyanide is a strong depressant for pyrite ($FeS_2$), and can be used to "deactivate" sphalerite that has been activated by copper ions in solution. As another example, lime, added as either CaO or $Ca(OH)_2$, dissolves to contribute calcium ions that can adsorb onto mineral surfaces. In combination with its strong alkaline nature, this makes lime particularly useful in manipulating sulfide flotation. Lime is considered less useful in oxide mineral flotation, because it can activate the flotation of silica by anionic collectors, causing it to float along with the other oxide minerals.

A large number of organic compounds are also useful as flotation depressants including, for example, soluble polymers (such as starch) that selectively coat mineral surfaces and thereby prevent one or more collector from attaching. Starch can be used, for example, in the "reverse" flotation for separating silica from iron ore, in which the silica tailings are floated using a cationic collector at a pH of 8.5-11, while leaving the iron oxide minerals behind in the pulp. Starch acts as a depressant for iron oxide in this process, preventing it from being floated by the cationic collector.

In preferred embodiments, the facilitator compound may be an onium compound, such as a quaternary ammonium compound. These facilitators are useful in many frothing processes including the separation of sulfide minerals. These compounds improve the selectivity of xanthates and/or other collectors for sulfide mineral species in froth flotation processes. These compounds may be applied in the presence of one or more collector compounds for increasing the mass pull (the amount of material reporting to concentrate versus tails) while maintaining target selectivity and requiring a lower collector concentration. These compounds may also reduce the quantity of other frothers necessary for adequate performance by increasing mass pull, again while maintaining target selectivity. These compounds may improve the upgrading of nickel or copper concentrate prior to matte separation processes by enhancing nickel flotation and thereby improve the copper versus nickel separation in sulfide flotation processes. These compounds also act as selective collectors for minerals previously activated by flotation collectors and subsequently exposed to a collector deactivation process using a deactivator compound such as, for example, cyanide compounds, the addition of which inhibits the ability of xanthine collectors by interfering with the chemisorbtion of xanthate on to mineral surfaces by complexing with metal ions at the mineral surface.

Onium compounds are cations (with their counter-ions) derived by adding a hydron (the cationic form of atomic hydrogen) to a mononuclear parent hydride from the nitrogen, chalcogen or halogen families. Representative oniums include, for example, ($H_4N^+$) ammonium, ($H_3O^+$) oxonium, ($H_2F^+$) fluoronium, ($H_4P^+$) phosphonium, ($H_3S^+$) sulfonium, ($H_2Cl^{+)}$ chloronium, ($H_4As^+$) arsonium, ($H_3Se^+$) selenonium, ($H_2Br^+$) bromonium, ($H_4Sb^+$) stibonium, ($H_3Te^+$) telluronium, ($H_2I^+$) iodonium and ($H_4Bi^+$) bismuthonium.

Onium derivatives may be formed by substitution of the above parent ions by univalent groups. The number of substituted hydrogen atoms is, especially in the case of hydrocarbyl substituents, indicated by the adjectives primary, secondary, tertiary or quaternary, e.g., ($Cl_2F^+$) dichlorofluoronium, $(CH_3)_2S^+H$ dimethylsulfonium (a secondary sulfonium ion), $Cl(CH_3)_3P^+$ chlorotrimethylphosphonium, $(CH_3CH_2)_4N^+$ tetraethylammonium (a quaternary ammonium ion). The products of these substitutions include arsonium compounds, halonium ions, oxonium ions, phosphonium compounds, quaternary ammonium compounds, stibonium compounds and sulfonium compounds. Quaternary ammonium compounds such as alkyldimethylbenzylammonium chloride or alkyldimethylbenzylammonium carbonate/bicarbonate may be preferred in some embodiments.

Other derivatives may be formed by substitution of the above parent ions by groups having two or three free valencies on the same atom. Such derivatives are, where possible, designated by a specific class name, e.g., $RC{=}O^+$ hydrocarbylidyne oxonium ions, $R_2C{=}N^+H_2X^-$ iminium compounds, $RC{=}NH^+$ nitrilium ions.

At facilitator addition rates ranging from (a) about 2 ppm to 1000 ppm, about 10 ppm to 500 ppm, or more preferably, about 10 ppm to 100 pm, based on slurry volume or (b) about 1 to 500 grams, about 10 to 200 grams, or more preferably, about 10 to 100 grams, per tonne based on dry solids content of the slurry, the disclosed methods offer significant improvements in mineral recovery in both the rougher concentrate as well as the rougher concentrate cleaning. In addition, there is significant improvement in selectivity and recovery observed in the cleaning stage of rougher concentrate using one or more onium compounds, particularly quaternary ammonium compounds, in dosages ranging from (a) about 2 ppm to 1000 ppm, about 10 ppm to 500 ppm, or more preferably, about 10 ppm to 100 pm, based on slurry volume or (b) about 1 to 500 grams, about 10 to 200 grams, or more preferably, about 10 to 100 grams, per tonne based on the dry solids content of the slurry after treatment with sodium cyanide to destroy xanthate collector(s) present in the rougher concentrate.

In addition, specific enhancement of nickel recovery from polymetallic ore containing various proportions of chalcopyrite, millerite, pyrrhotite and pentlandite was achieved by adding an onium compound, particularly a quaternary ammonium compound, in the presence of a xanthate collector, specifically potassium amyl xanthate ("PAX"). It has also been discovered that the addition of one or more onium compounds, particularly quaternary ammonium compounds, in dosages ranging from (a) about 2 ppm to 1000 ppm, about 5 ppm to 500 ppm, or more preferably, about 5 ppm to 100 pm, based on slurry volume or (b) about 1 to 500 grams, about 5 to 200 grams, or more preferably, about 5 to 100 grams, per tonne based on dry solids content of the slurry to porphyry copper ore prior to rougher flotation enhances copper and/or gold collection in the rougher concentrate.

In embodiments, a broad range of cationic species, including both organic and inorganic compounds, e.g., Aluminum $Al^{3+}$, Cerium $Ce^{3+}$ may be alternatives to the onium compounds detailed herein. Organics are particularly useful because they can maintain their cationic nature over a broad pH range. Inorganic compounds may also be used, for example, when the pH of the matrix is maintained within a proper, and more precise range, than that permitted with the organic compounds. For example, quaternary phosphonium compounds may provide additional utility.

Frothing

Disclosed methods may include forming a froth including a concentrate comprising the target material. Frothing agents, also known as frothers, may also be introduced into the pulp to promote the formation of a stable froth on top of the flotation cell. As with the collectors, froth flotation can utilize a number of frother compounds including, for example, pine oil, alcohols (e.g., methyl isobutyl carbinol (MIBC)), polyglycols, polyoxyparafins, cresylic acid (xylenol) and mixtures thereof. Other modifiers may also be added to the pulp or slurry to control other characteristics including, for example, pH modifiers such as lime (CaO), soda ash ($Na_2CO_3$), caustic soda (NaOH), inorganic acids ($H_2SO_4$, HCl) and mixtures thereof, cationic modifiers such as $Ba^{2+}$, $Ca^{2+}$, $Cu^+$, $Pb^{2+}$, $Zn^{2+}$, $Ag^+$ and mixtures thereof, anionic modifiers such as $SiO_3^{2-}$, $PO_4^{3-}$, $CN^-$, $CO_3^{2-}$, $S^{2-}$ and mixtures thereof organic modifiers such as dextrin, starches, glue, gums, carbomethyl cellulose (CMC or cellulose gum) and mixtures thereof.

Froth flotation efficiency is determined by a series of probabilities: those of particle-bubble contact, particle-bubble attachment, transport between the pulp and the froth, and froth collection into the product launder. In a conventional mechanically-agitated cell, the void fraction (i.e., volume occupied by air bubbles) is low (5 to 10 percent) and the bubble size is usually greater than 1 mm. This results in a relatively low interfacial area and a low probability of particle-bubble contact. Consequently, several cells arranged in series are typically utilized for increasing the effective particle residence time and thereby increasing the probability of particle-bubble contact.

The minerals that are not carried up into the froth are referred to as the flotation tailings or flotation tails. These tailings may also be subjected to further stages of flotation to recover the valuable particles that did not float the first time in a process known as scavenging. The final tailings are those materials that were not recovered in any of the scavenging stages and are typically separated for disposal as mine fill or for transfer to a tailings disposal facility for long-term storage.

Embodiments may also include cleaning the rougher concentrate through a flotation process to separate additional particles of the undesirable minerals that were included in the initial froth. This process is referred to as cleaning and is utilized to increase the purity of the concentrate. Similarly, the cleaning step may also be followed by one or more scavenging steps applied to the cleaner tailings under conditions utilizing different operating conditions and/or chemistries than used during the initial scavenging in order to recover additional amounts of the target mineral and may also include some secondary grinding to provide further liberation of the target mineral and gangue.

Embodiments may include scavenging the rougher tailings removed from the initial flotation step through one or more scavenger flotation steps that recover some of the target minerals that are inevitably still present in the tailings. The scavenger flotation steps may utilize different operating conditions and/or chemistries than used during the initial roughing in order to recover additional amounts of the target mineral and may also include some secondary grinding to provide further liberation of the target mineral and gangue.

The concentrate from the rougher scavengers may be returned to the rougher feed for refloating, may be mixed with the rougher cleaner concentrate for subsequent separation in the case of polymetallic ores or may be subjected to a separate cleaning operation.

In another embodiment, there is provided a method for separating at least one target material from a slurry comprising a raw material. The method may include adding a facilitator compound to a raw material slurry that has been treated with a collector compound and a reagent for neutralizing the collector compound; forming a froth including a concentrate of the target material; and extracting the concentrate of the target material from the froth. The facilitator compound may increase the relative hydrophobicity of a surface of the raw material to form the froth including the concentrate of the target material.

Examples

Flotation testing was conducted to determine the impact of a representative quaternary ammonium solution, ML2005 (50% quat), on flotation recovery using a copper/nickel ore. The testing was conducted on three different days and targeted two different steps in the mineral (froth flotation) upgrading process. The testing was conducted under laboratory conditions utilizing industry standard flotation procedures with blind assays of final concentrates and tailings by an accredited laboratory.

The first two days of testing were conducted on copper rougher cleaner concentrate to determine the impact of a representative quaternary ammonium compound on metal recovery and selectivity. A third day of testing was conducted on rougher cleaner concentrate that had been exposed to cyanide compound for xanthate deactivation before being tested with the representative quaternary ammonium compound. The initial test analysis was based on four criteria: 1) total mass recovered, 2) relative copper recovery, 3) relative nickel recovery and 4) the ratio of copper to nickel in final concentrate.

As reflected in the data presented below in Table 1, the representative quaternary ammonium compound significantly increased the copper recovery at dosages up to 25 ppm (weight of ML2005 per volume of slurry) in Test 1 (Day 1) and 100 ppm in Test 2 (Day 2) in rougher copper concentrate floats in the absence of cyanide. After cyanide addition, the same representative quaternary ammonium compound appeared to inhibit copper recovery (Test 3/Day 3). Thus, the representative quaternary ammonium compound acted as a selective copper promoter in the presence of xanthate allowing improved copper recovery, the impact of which was negated by the indiscriminate xanthate deactivation resulting from the cyanide introduction.

TABLE 1

Copper - Increase in Mass of Concentrate (%) versus Average Baseline
(Copper recovery was evaluated by examining a relative copper recovery number arrived at by multiplying % mass recovered by copper assay for cumulative concentrates)

| | FACILITATOR CONCENTRATION (VOLUMETRIC) | | | | | | | |
|---|---|---|---|---|---|---|---|---|
| Test # | 3 PPM | 5 PPM | 10 PPM | 20 PPM | 25 PPM | 40 PPM | 50 PPM | 100 PPM |
| Test 1 | | | 10.08% | | 17.41% | | 11.70% | |
| Test 2 | | 3.86% | 3.30% | | 4.16% | | 7.87% | 13.43% |
| Test 3 | 0.32% | −0.44% | 2.91% | 1.74% | | 3.20% | | |

Figure 3:
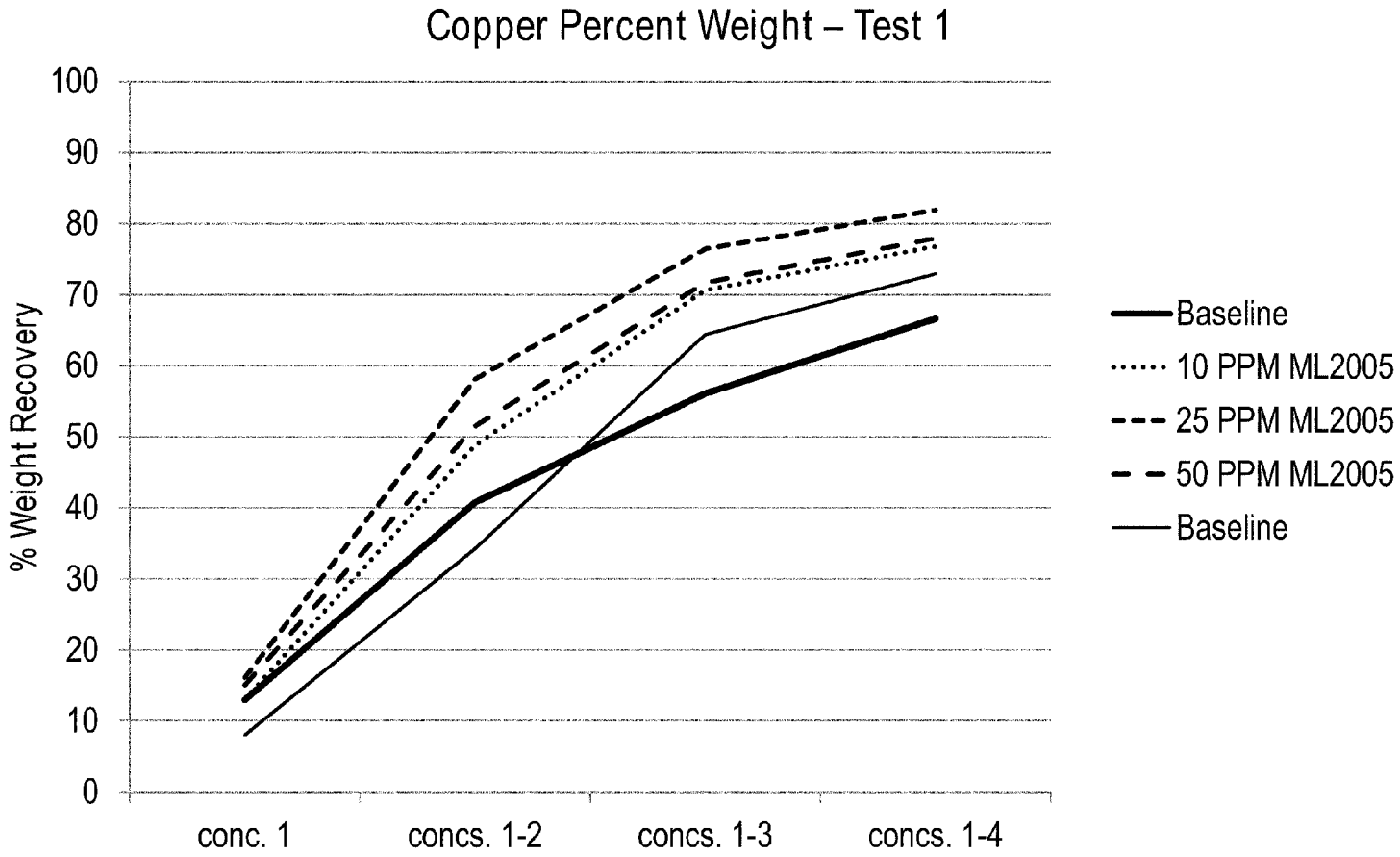
FIG. 3 is a graph illustrating the results of a weight recovery test according to an embodiment.

FIGS. 3-10 illustrate the results of additional analysis from Tests 1-3. In FIGS. 1-3, weight percent recovery is shown. In FIGS. 1-3, weight recovery is measured on the y-axis and represents the cumulative percent weight of solids recovered from a froth as compared to total weight of the slurry sample. As the froth develops in the flotation circuit, the froth is periodically removed, dried, and analyzed by measuring the weight of residual solids. The x-axis represents the cumulative results of four such measurements made during Tests 1-3. For example, on the x-axis, each concentration refers to a froth sample where concentration 1 refers to the first froth capture during the first minute of frothing, concentration 1-2 refers to the second froth capture during the second minute of frothing plus the content of the first froth capture, and so on.

As shown in the legend, the Tests were run using various concentrations of quaternary onium solution, ML2005, that is added to the flotation circuit. The concentrations are measured in PPM (mg of ML2005 (50% active ingredient) in a L of slurry volume). The baseline measures slurry sample without ML2005 added. The baseline and the test samples each include xanthate as a collector and a frothing agent.

Figure 4:
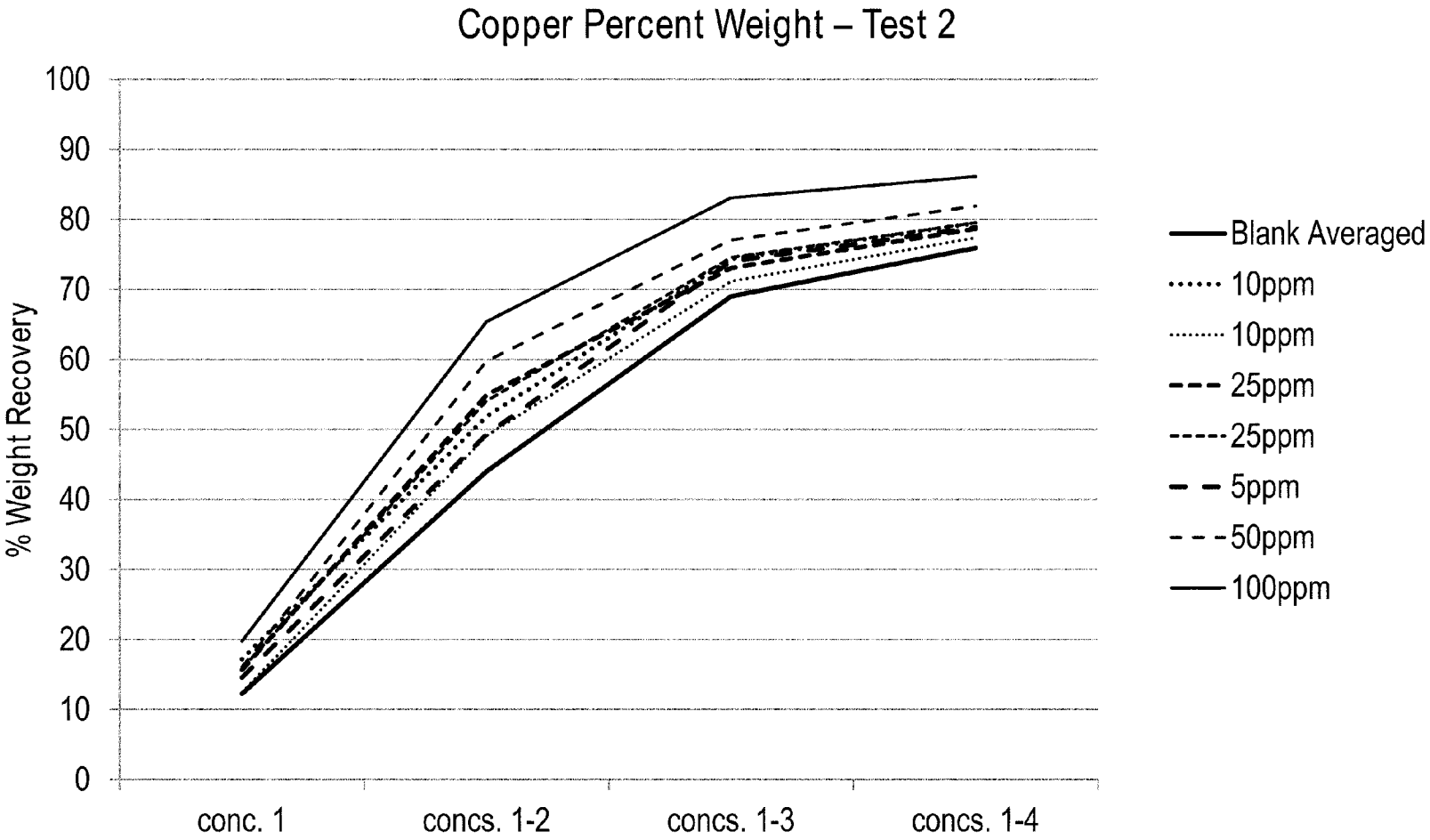
FIG. 4 is a graph illustrating the results of a weight recovery test according to an embodiment.
Figure 5:
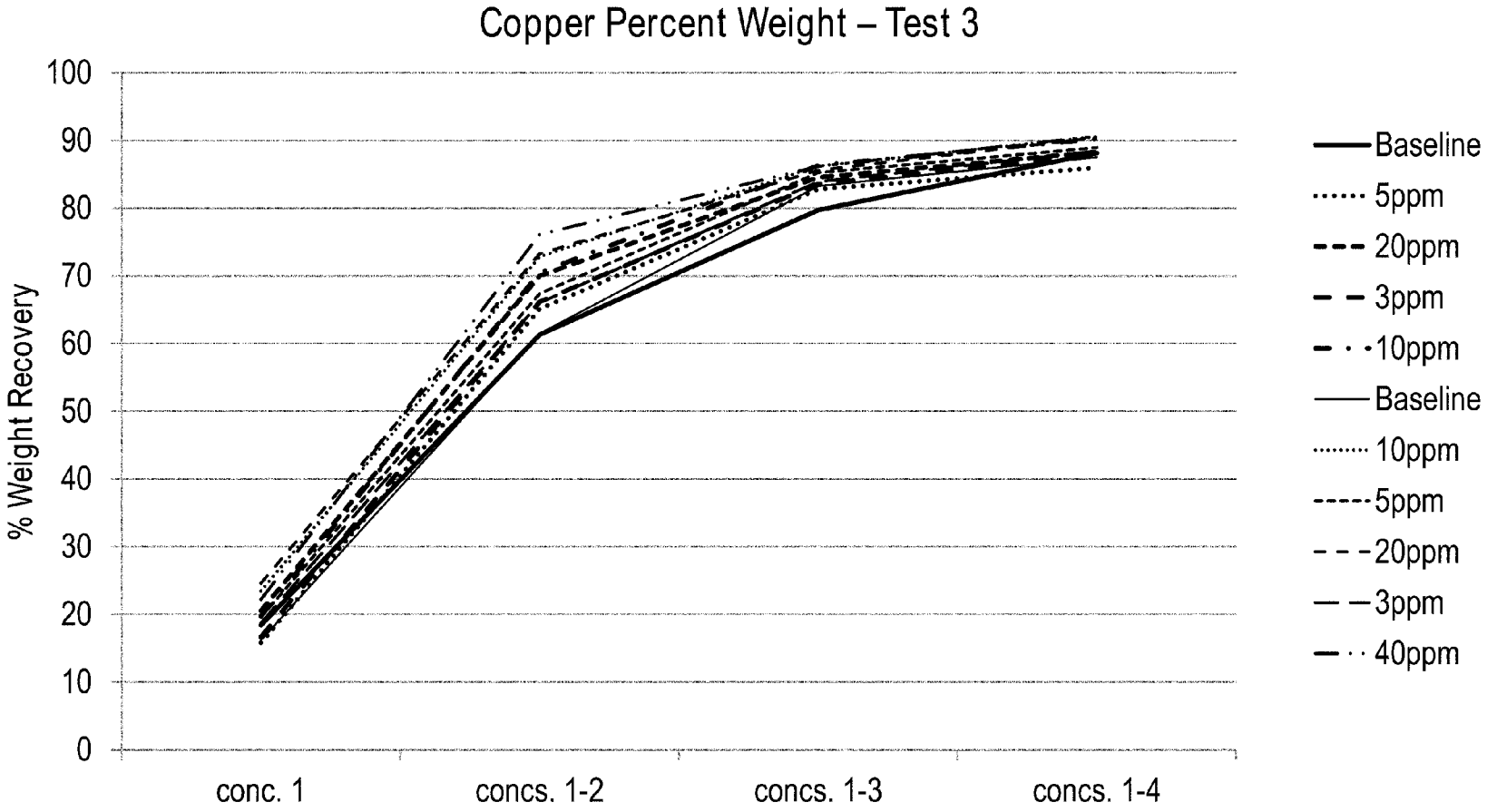
FIG. 5 is a graph illustrating the results of a weight recovery test according to an embodiment.
Figure 6:
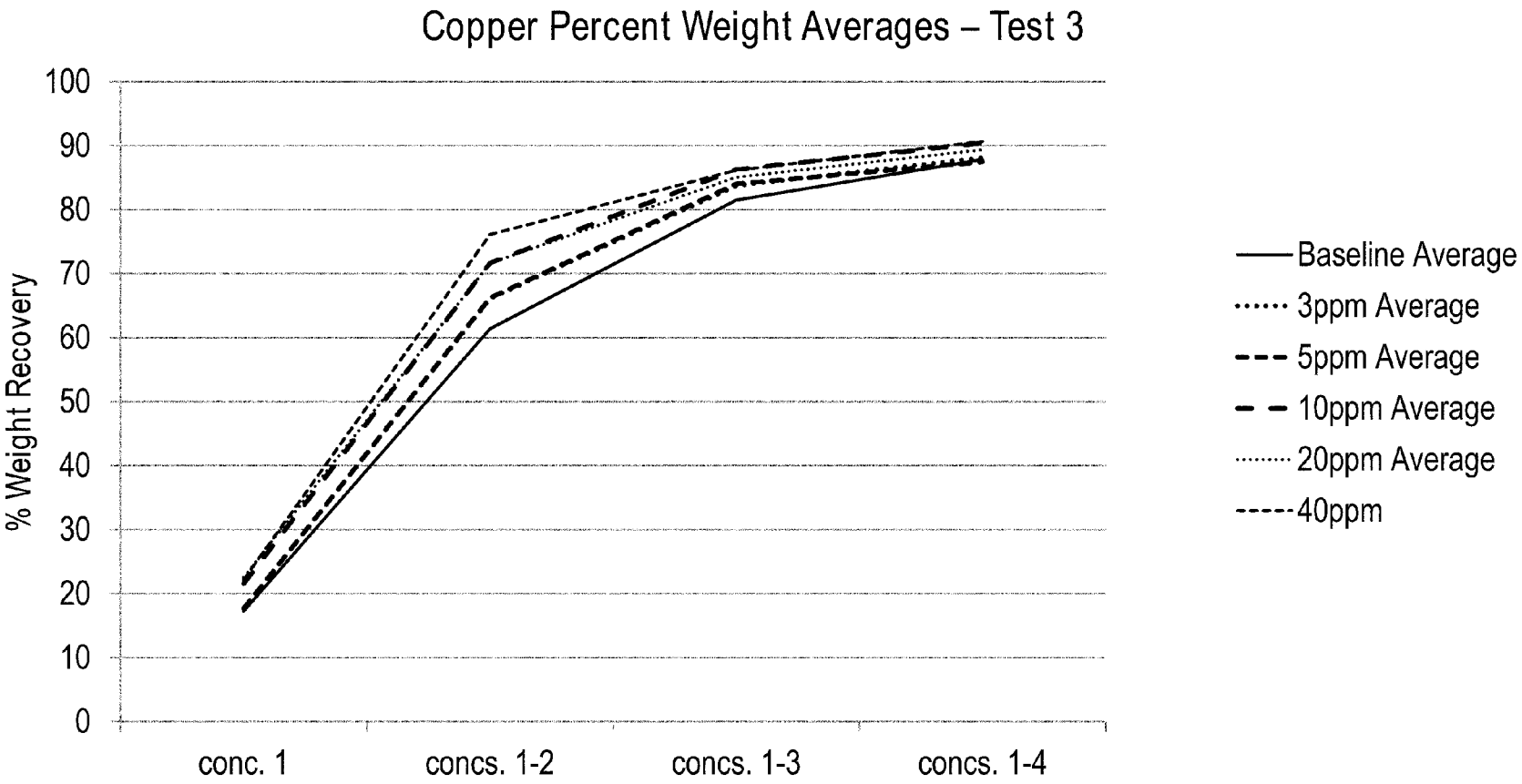
FIG. 6 is a graph illustrating the results of a weight recovery test according to an embodiment.

FIGS. 3 and 4 correspond to Tests 1 and 2 using the same methodology (i.e., a slurry including xanthate, frothing agent and ML2005 in the test samples). As shown in FIG. 3, the addition of 25 PPM ML2005 produces higher copper mineral recovery by % weight recovery as compared to other concentrations of ML2005 and the baseline tests, and recovers weight at a faster rate (i.e., the slope of the line is steeper). FIG. 4 shows similar results except that the 100 PPM ML2005 appears to show the best performance. FIG. 5 shows results for copper mineral recovery after cyanide has been added to the slurry (i.e., a slurry including xanthate, frothing agent, ML2005 and cyanide). As seen in FIG. 5, the 40 PPM ML2005 performs best but to a lesser degree than the higher concentrations of ML2005 did in Tests 1 and 2 where cyanide was not added. FIG. 6 illustrates the mean values for the duplicate Tests run in FIG. 5. As a whole, these test results surprisingly show that the ML2005 acted as a selective copper promoter in the presence of xanthate allowing greater copper mineral recovery at faster rates, the impact of which was somewhat negated by the xanthate deactivation resulting from the cyanide introduction.

Figure 7:
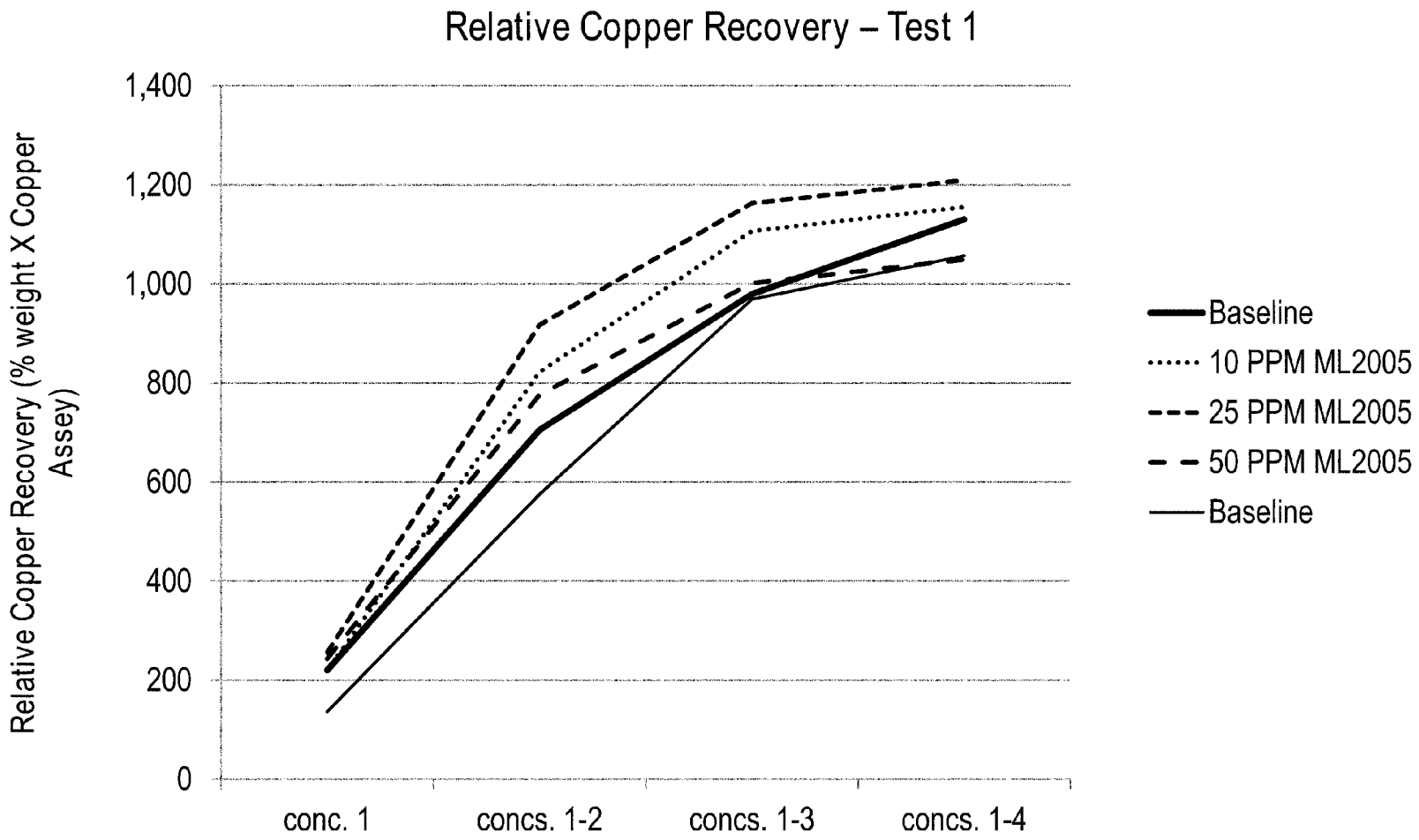
FIG. 7 is a graph illustrating the results of a relative copper recovery test according to an embodiment.
Figure 8:
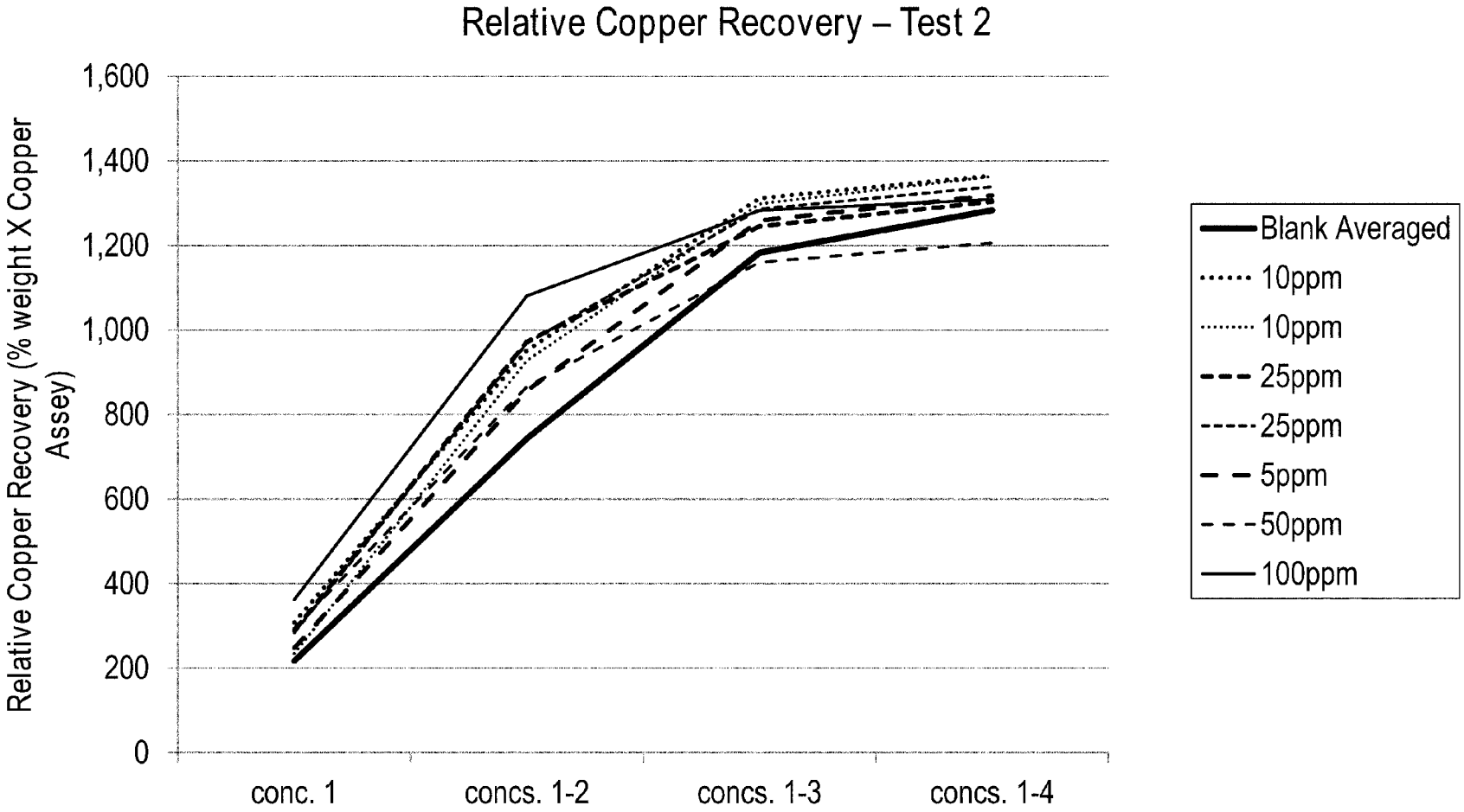
FIG. 8 is a graph illustrating the results of a relative copper recovery test according to an embodiment.
Figure 9:
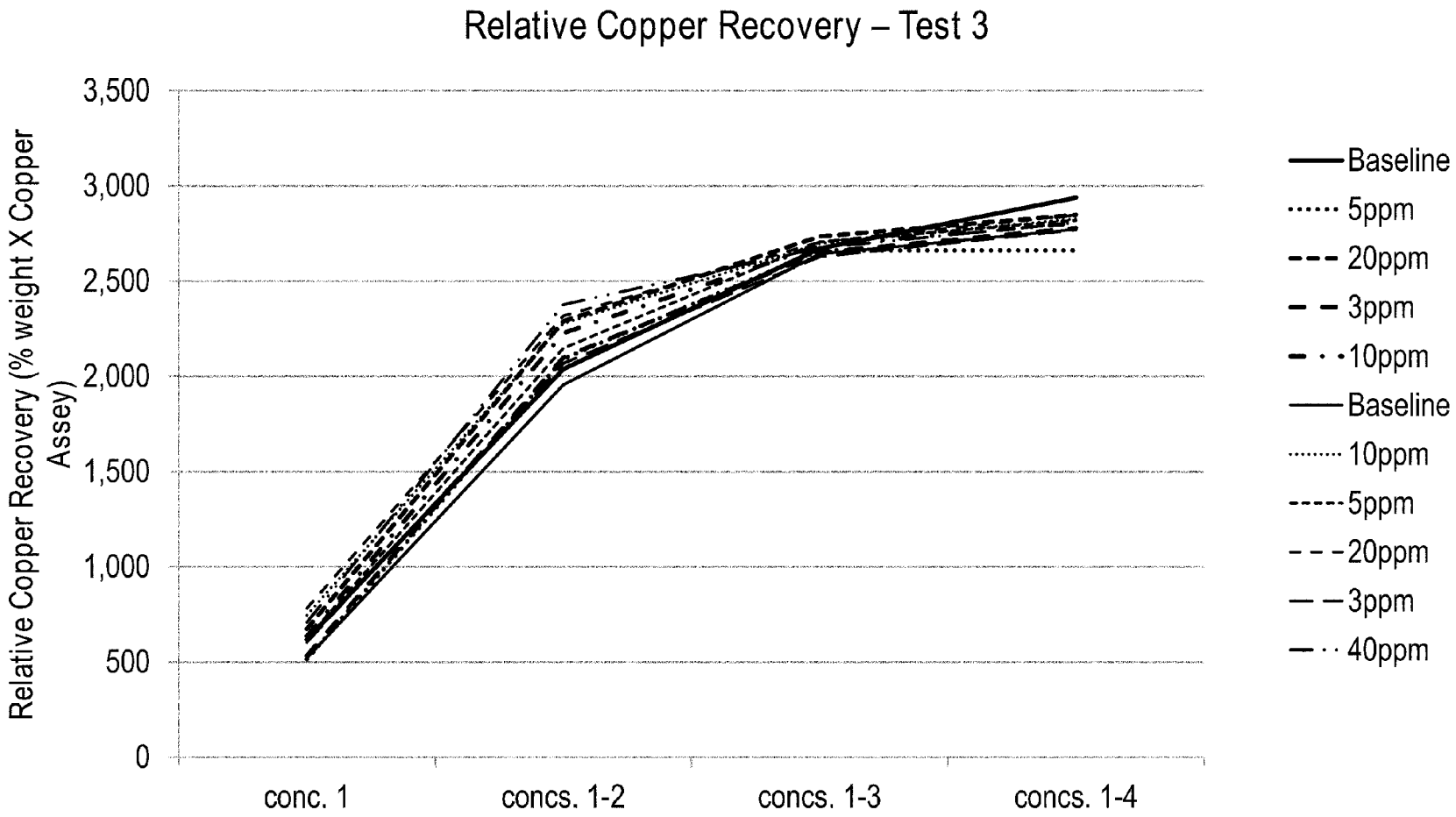
FIG. 9 is a graph illustrating the results of a relative copper recovery test according to an embodiment.
Figure 10:
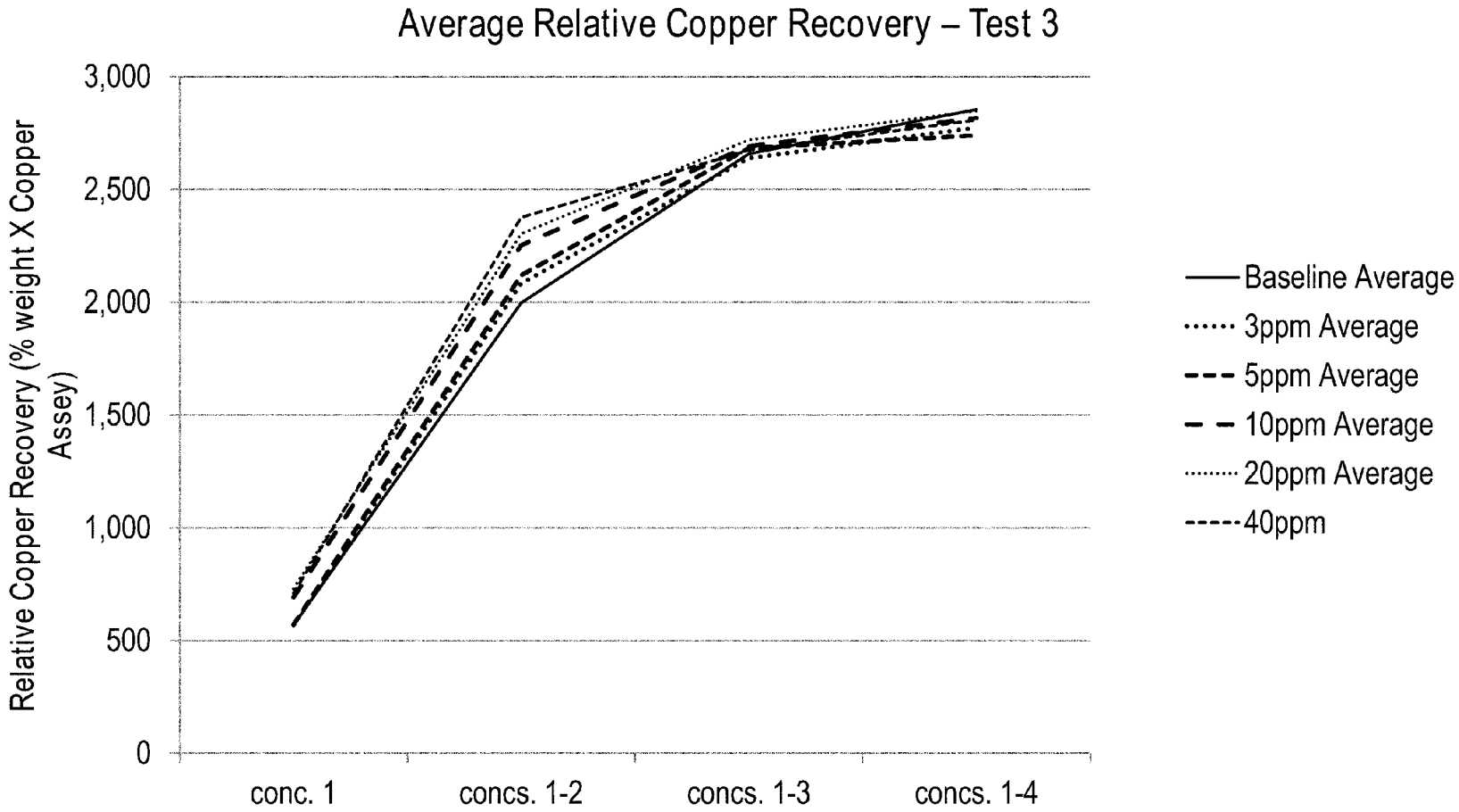
FIG. 10 is a graph illustrating the results of a relative copper recovery test according to an embodiment.

FIGS. 7-10 correspond to FIGS. 3-6 described above except that FIGS. 7-10 incorporate a measure of the purity of the mineral recovery (i.e., the relative amount of copper recovered in the froth solids of Tests 1-3). In FIGS. 7-10, the y-axis constitutes the product of percent weight recovery (as in FIGS. 3-6) and the measured copper purity. FIG. 7 shows that in addition to faster and higher copper recovery at 25 PPM ML2005, the purity of the copper mineral recovered is higher. FIG. 8 shows similar results in Test 2 at 100 PPM ML2005 up to the concentration 1-3 where the differentiation between various ML2005 concentrations is less distinct. FIGS. 9 and 10 show similar results in Test 3 at 40 PPM ML2005 up to the concentration 1-3 where the differentiation between various ML2005 concentrations is less distinct. These results illustrate the increased purity of the copper mineral with the addition of ML2005.

Table 2 below shows the results of using a facilitator compound in nickel recovery. As reflected in the data presented below in Table 2, the representative quaternary ammonium compound significantly increases the nickel recovery at dosages up to 25 ppm in slurry volume in Test 1 (Day 1) and 100 ppm in Test 2 (Day 2) in rougher copper concentrate floats in the absence of cyanide. Once the cyanide had been added (Test 3/Day 3), the representative quaternary ammonium compound further increased nickel recovery. Therefore, the representative quaternary ammonium compound can act as a selective collector on mineral species, such as nickel, that were previously activated by xanthate and then deactivated by cyanide addition.

TABLE 2

Increase in Relative Nickel Recovery versus average baseline
(Nickel recovery was evaluated by examining a relative nickel recovery number arrived at by multiplying % mass recovered by nickel assay for cumulative concentrates)

| | FACILITATOR CONCENTRATION (VOLUMETRIC) | | | | | | | |
|---|---|---|---|---|---|---|---|---|
| Test # | 3 PPM | 5 PPM | 10 PPM | 20 PPM | 25 PPM | 40 PPM | 50 PPM | 100 PPM |
| Test 1 | | | 15.24% | | 22.14% | | 15.28% | |
| Test 2 | | 6.23% | 7.23% | | 5.75% | | 11.45% | 13.14% |
| Test 3 | 6.96% | 4.30% | 40.76% | 31.83% | | 49.64% | | |

It will be appreciated that the above-disclosed features and functions, or alternatives thereof, may be desirably combined into different systems or methods. Also, various alternatives, modifications, variations or improvements may be subsequently made by those skilled in the art, and are also intended to be encompassed by the following claims. As such, various changes may be made without departing from the spirit and scope of this disclosure as defined in the claims.

What is claimed is:

1. A method for separating at least one target material from a raw material, the method comprising:

mixing the raw material, which includes the target material, with water to form a slurry;

adding at least one collector compound to the slurry that associates with a surface of the target material and modifies the hydrophobicity of the surface;

adding a facilitator compound to the slurry, the facilitator compound being effective to enhance the modification of the hydrophobicity of the target material surface by the collector compound; and forming a froth including a concentrate of the target material.

2. The method according to claim 1, wherein the facilitator compound is an organic compound.

3. The method according to claim 1, wherein the facilitator compound is an inorganic compound.

4. The method according to claim 1, wherein the facilitator compound is an onium compound.

5. The method according to claim 4, wherein the onium compound is selected from the group comprising ammonium, oxonium, fluoronium, phosphonium, sulfonium, chloronium, arsonium, selenonium, bromonium, stibonium, telluronium, iodonium and bismuthonium, and mixtures thereof.

6. The method according to claim 1, wherein the facilitator compound is added in an amount ranging from 2 ppm to 1000 ppm based on the slurry volume.

7. The method according to claim 6, wherein the facilitator compound is added in an amount of about 5 ppm to 100 ppm based on slurry volume.

8. The method according to claim 1, wherein the facilitator compound is added in amount ranging from about 1 to 500 grams per tonne based on dry solids content.

9. The method according to claim 1, wherein the facilitator compound facilitates the ability of the collector to adsorb onto the surface of the target material.

10. The method according to claim 9, wherein the facilitator compound is copper sulfate.

11. The method according to claim 1, wherein the facilitator compound increases a selectivity of the collector compound for the surface of the target material by acting on a surface of a non-target material in the raw material.

12. The method according to claim 1, wherein the collector compound acts on the surface of the target material to increase the hydrophobicity of the surface.

13. The method according to claim 1, wherein the collector compound decreases the hydrophobicity of the surface of a target material.

14. The method according to claim 1, wherein the collector compound is a surfactant.

15. The method according to claim 14, wherein the surfactant is a xanthate compound.

16. The method according to claim 15, wherein the xanthate compound is selected from the group comprising sodium ethyl xanthate, xanthate compounds include, potassium amyl xanthate, potassium ethyl xanthate, potassium isobutyl xanthate, sodium isobutyl xanthate, sodium isopropyl xanthate, and mixtures thereof.

17. The method according to claim 1, wherein the collector compound is selected from the group comprising dithiophosphates, thiocarbamates, xanthogen formates, thionocarbamates, thiocarbanilide, palmatic acid and mixtures thereof.

18. The method according to claim 13, wherein the collector compound is an amine.

19. The method according to claim 13, wherein the collector compound is selected from the group comprising cyanide, lime, starch and mixtures thereof.

20. The method according to claim 1, further comprising the step of adding a frothing agent to stabilize the froth.

21. The method according to claim 20, wherein the frothing agent is selected from the group comprising pine oil, alcohols, polyglycols, polyoxyparafins, cresylic acid, and mixtures thereof.

22. The method according to claim 1, wherein the target material is selected from the group comprising copper, nickel, zinc, lead, platinum group metal ores, gold ores and mixtures thereof.

23. The method according to claim 1, wherein the collector compound acts on the surface of the target material by at least one of chemisorption and physisorption.

24. The method according to claim 1, further comprising extracting the concentrate of the target material from the froth.

25. A method for separating at least one target material from a slurry comprising a raw material, the method comprising:

adding a first facilitator compound to the raw material slurry, the first facilitator compound being effective to enhance a modification of a hydrophobicity of a surface of a first target material that has been treated with a first collector compound;

forming a first froth including a first concentrate of the first target material;

extracting the first concentrate of the first target material from the first froth;

adding a deactivation compound to the slurry that deactivates the first collector compound;

adding a second facilitator compound being effective to enhance the modification of the hydrophobicity of the surface of the second target material;

forming a second froth including a second concentrate of the second target material; and extracting the second concentrate of the second target material from the froth.

26. The method according to claim 25, wherein the first target material includes copper.

27. The method according to claim 25, wherein the second target material includes nickel.

28. The method according to claim 25, further comprising adding a second collector compound to the slurry that associates with a surface of a second target material and modifies a hydrophobicity of the surface of the second target material.

29. A method for separating at least one target mineral from a raw material, the method comprising:

mixing a metal sulfide ore, which includes the target mineral, with water to form a slurry;

adding at least one xanthate compound to the slurry;

adding an onium facilitator compound to the slurry;

forming a froth including a concentrate of the target mineral; and extracting the concentrate of the target mineral from the froth.

30. The method according to claim 4, wherein the onium compound is a quaternary ammonium compound.

31. The method according to claim 30, wherein the quaternary ammonium compound is selected from the group consisting of alkyldimethylbenzylammonium chloride, alkyldimethylbenzylammonium carbonate and alkyldimethylbenzylammonium bicarbonate.

32. The method according to claim 4, wherein the quaternary ammonium compound is added in an amount in a range of 5 ppm to 100 ppm based on slurry volume.

* * * * *